US006520817B1

(12) United States Patent
Salzman

(10) Patent No.: US 6,520,817 B1
(45) Date of Patent: Feb. 18, 2003

(54) RESCUE AID DEVICE AND METHOD FOR USING SAME

(76) Inventor: Allan J. Salzman, 56 Williams Rd., Sharon, MA (US) 02067

( * ) Notice: Subject to any disclaimer, the term of this patent is extended or adjusted under 35 U.S.C. 154(b) by 0 days.

(21) Appl. No.: 09/843,271

(22) Filed: Apr. 26, 2001

(51) Int. Cl.[7] ..... B63C 9/32
(52) U.S. Cl. ..... 441/82; 280/19.1
(58) Field of Search ..... 441/82; 280/19.1, 280/24

(56) References Cited

U.S. PATENT DOCUMENTS 3,845,779 A 11/1974 Greene, Jr. ..... 137/209
3,923,335 A * 12/1975 Erickson ..... 280/19.1
3,981,526 A 9/1976 Lundqvist ..... 294/25
4,079,953 A * 3/1978 Howarth, Jr. ..... 280/19
5,087,060 A * 2/1992 Rogalski et al. ..... 280/12.11
5,320,567 A 6/1994 Beer ..... 441/82
5,427,557 A 6/1995 Lunden, Sr. ..... 441/82
5,624,292 A 4/1997 Wiseman, Jr. ..... 441/80

* cited by examiner

*Primary Examiner*—Jesus D. Sotelo
(74) *Attorney, Agent, or Firm*—Bromberg & Sunstein LLP

(57) ABSTRACT

A rescue aid device and method for using same includes a base that can be affixed to ice or snow, for example, using spikes or mechanical fasteners. The affixed base is used as a secure platform for effectuating a rescue. The rescue aid device may include a winch to help pull a victim or other load to safety.

13 Claims, 2 Drawing Sheets

RESCUE AID DEVICE AND METHOD FOR USING SAME

FIELD OF THE INVENTION

The present invention relates to a device for aiding a rescue and a method for using said device to aid in a rescue.

BACKGROUND OF THE INVENTION

In times when ice and snow cover the ground, it is not uncommon to hear tales of people who fall through thin ice or get stuck in the snow. Unfortunately, rescue of the victim is often difficult, time-consuming, and, sadly, unsuccessful. This is because ice and snow rescues pose a variety of problems for both the victim and potential rescuers.

One problem for both the victim and potential rescuers is that the ice and snow is slippery. This makes it difficult for the victim to extricate himself or herself. This also makes it difficult for potential rescuers to reach the victim and pull the victim to safety.

Another problem for both the victim and potential rescuers is that the victim's location is often inconvenient. For example, the victim could have fallen through thin ice in the middle of a lake or fallen into a gully in the mountains. This makes it difficult for potential rescuers to reach the victim, particularly with cumbersome rescue equipment.

Yet another problem for potential rescuers is that, by attempting a rescue, the rescuer is put at risk for befalling the same fate as the victim. This is because ice and snow at the victim's location is often unstable. For example, if the victim fell through thin ice into a lake, then it is likely that the surrounding ice will be weak, and may break under the weight of a potential rescuer.

For these and other reasons, potential rescuers are often told to extend an object, such as a tree branch, ladder, boat, or rope, to the victim. Unfortunately, such objects may not be found at the victim's location, and it may be difficult to bring such objects to the victim's location and extend them to the victim. Furthermore, any potential rescuer that ventures onto ice is often told to slide out to the victim in a prone position so as to distribute bodily weight over a greater area of the ice. Even if the potential rescuer is able to reach the victim, either bodily or with an extended object, it is often difficult for the potential rescuer to effectuate the rescue, particularly because the ice and snow make it difficult for the potential rescuer to remain steady, maintain control over the extended object, and use the extended object to pull the victim to safety.

Complicating matters, the victim is often at risk for hypothermia. Therefore, it is particularly important for any rescue to be completed as quickly as possible. The various issues described above make it difficult to effectuate a quick rescue.

SUMMARY OF THE INVENTION

A small, portable rescue aid device includes a base that can be affixed to ice or snow, for example, using spikes or mechanical fasteners. The affixed base is used as a secure platform for effectuating a rescue. For example, the affixed base can be used to secure an object (such as a rope) that can be extended to the victim, as a gripping point for the potential rescuer, or as a secure footing for the potential rescuer, to name but a few. The rescue aid device may include a winch to help pull a victim or other load to safety.

DETAILED DESCRIPTION OF A PREFERRED EMBODIMENT

Figure 1:
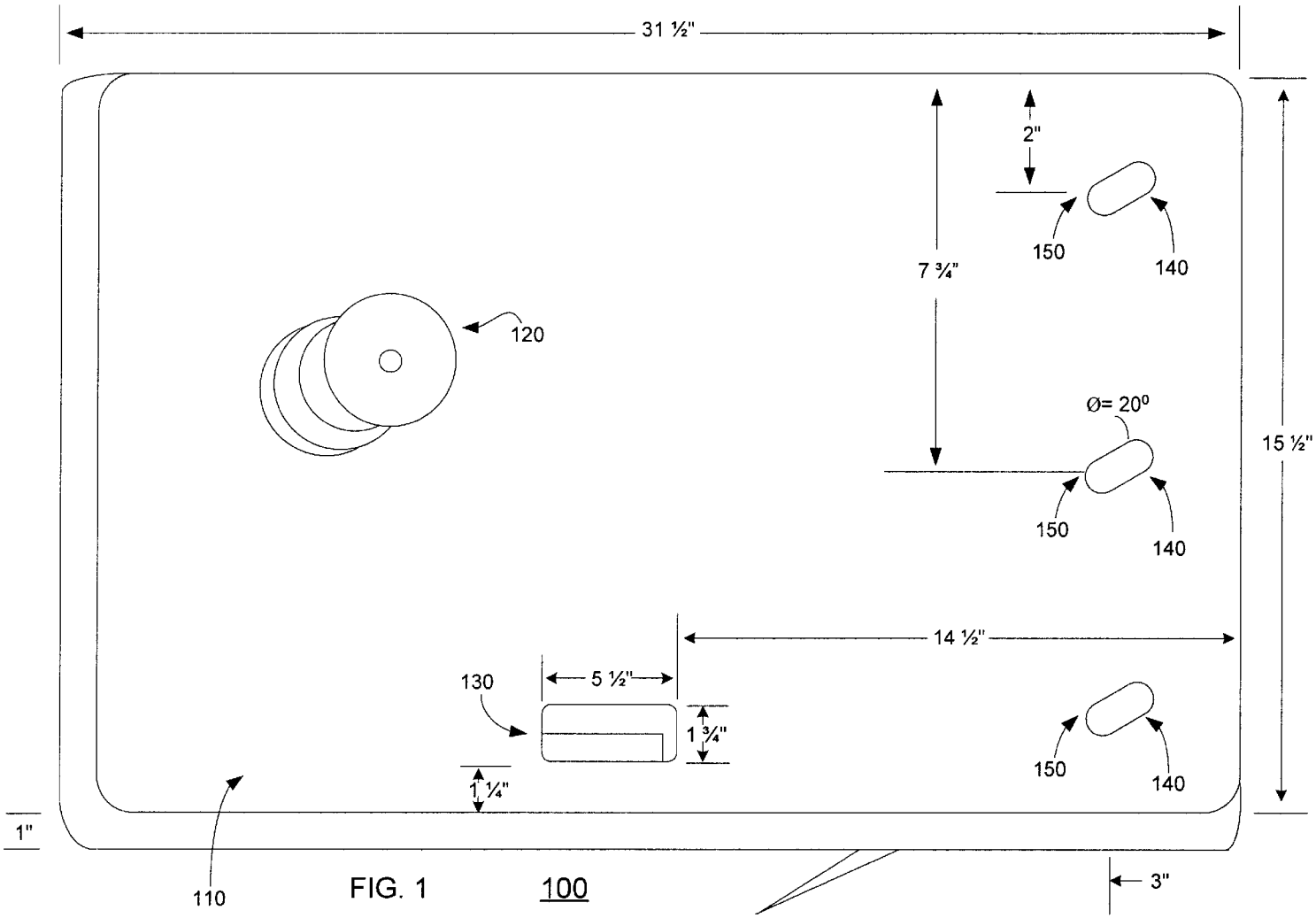
FIG. 1 is a schematic diagram showing an exemplary rescue aid device with mechanical fasteners and a winch in accordance with an embodiment of the present invention.

A small, portable rescue aid device for use in ice, snow, and water rescues is described. The rescue aid device includes a base that can be affixed to ice or snow. The affixed base is used as a secure platform for pulling a victim or other load to safety. For the sake of convenience, the victim or other load that is extricated using the rescue aid device is referred to hereinafter simply as the victim, although it should be noted that the victim need not be a person according to this definition. The affixed base can be used to aid a rescue in any of a variety of ways. For example, the affixed base can be used to secure an object (such as a rope) that can be extended to the victim, as a gripping point for the potential rescuer, or as a secure footing for the potential rescuer, to name but a few.

The base is typically a thin block that is substantially rectangular in shape, although the present invention is not limited to any particular base shape. In any case, the base typically has a definite front, back, top, and bottom. In a rectangular-shaped base, the broad, flat surfaces are typically the top and bottom, respectively, and the shorter sides are typically the front and back, respectively. When used in a rescue attempt, the base is preferably oriented so that the front is facing directly toward the victim, the back is facing directly away from the victim, the top is facing upward away from the ice or snow, and the bottom is facing downward toward the ice or snow.

The base may be made from any of a variety of materials. For example, the base may be made from materials such as plastic, resin, fiberglass, composite (e.g., carbon fiber), metal, or wood, to name but a few. The present invention is not limited to any particular base material.

The rescue aid device typically includes some type of handle by which the rescue aid device can be carried. The handle is typically integral to the base or attached to the base.

The base may be affixed to the ice or snow using any affixing means. In a typical embodiment of the invention, the base is affixed to the ice or snow using mechanical fasteners, such as nails/pins or screws, which are driven through pre-existing guide holes in the base and into the ice or snow. The pre-existing guide holes are typically located toward the back of the base and are typically angled forward so that the nails/pins or screws are driven into the ice or snow at an appropriate angle.

Alternative, or additionally, the base may be affixed to the ice or snow using some type of texture that is on or integral to the bottom of the base. For example, the bottom of the base may have integral spikes or ridges angled forward that can be depressed into the ice or snow. The spikes or ridges help to stop the base from slipping forward.

In some situations, such as deep snow or slush, mechanical fasteners and/or textures on or integral to the bottom of the base may be insufficient to secure the base. Therefore, the rescue aid device may include or be fitted with an apparatus for providing additional resistance to help stop the base from slipping forward. For example, the rescue aid device may include or be fitted with a device that acts as a snow plow or brake to provide resistance to help stop the base from slipping forward.

To help further secure the base to the ice or snow, the potential rescuer can place additional weight on the top of the base, for example, by standing or kneeling on the top of the base. The present invention is not limited by the means in which the base is affixed to the ice or snow.

The rescue aid device is typically provided with appropriate tools that are used by the potential rescuer to affix the base to the ice or snow. For example, the rescue aid device may be provided with nails/pins and a hammer or with screws and a screwdriver for affixing the base to the ice or snow.

The base is typically used in conjunction with a winch or other such device to help in pulling the victim to safety. In a typical embodiment of the present invention, the rescue aid device is provided with a winch, a winch handle, and a rope. The winch is typically attached to the top of the base toward the front, and can be used to secure the rope and provide a mechanical advantage to the potential rescuer for pulling on the rope. The winch handle can be attached to the winch for operating the winch. The present invention is not limited to any particular type of winch.

The rescue aid device typically includes some means for carrying the tools and the winch handle. For example, the rescue aid device may be provided with a drawstring bag for carrying the tools and the winch handle.

FIG. 1 shows an exemplary rescue aid device 100 in accordance with an embodiment of the present invention. Among other things, the rescue aid device 100 includes a base 110 having an integral handle 130 and integral guide holes 150, a winch 120, and three anchor pins 140.

In this exemplary embodiment, the base 110 is machined from a one-inch thick, solid billet of ultraviolet-stabilized high-density polyethylene. This material is strong, stable, and resistant to abrasion and water. The handle 130 is machined into the base 110 at a position that provides proper balance while carrying the rescue aid device 100.

In this exemplary embodiment, the base 110 is affixed to the ice or snow using the three anchor pins 140. The three guide holes 150 are machined into the base 110 for guiding the three anchor pins 140 into the ice or snow. The guide holes 150 are positioned toward the back of the base 110 and are angled forward at approximately twenty degrees from vertical so that the three anchor pins 140 are driven into the ice or snow at an appropriate angle. The anchor pins 140 are preferably machined from one-half inch diameter, 400-series stainless steel rods that are tapered approximately three inches from the piercing end and are impulse-hardened at the hammered end to resist chipping and deformation during repeated hammer blows. The anchor pins 140 are driven through the guide holes 150 and into the ice or snow using a supplied three pound hammer (not shown), typically leaving approximately one inch of the anchor pins 140 protruding above the base 110.

In this exemplary embodiment, the winch 120 is a commercially available winch known as an Andersen #10 non-self-tailing winch. The winch 120 is fastened to the top of the base 110 toward the front using four ¼-20×1-¼ FHMS stainless steel nuts and bolts (not shown). The winch 120 is 25 supplied with an eleven-inch stainless steel handle that can be detached from the winch 120 for portability and attached to the winch 120 for operating the winch 120. The winch 120 provides an 8.3:1 mechanical advantage to the potential rescuer for pulling on the rope (not shown).

When used to effectuate a rescue, the rescue aid device 100 is preferably placed on a substantially level surface where the victim is at or slightly below the level of the rescue aid device 100. For example, in a typical ice rescue, the rescue aid device 100 is typically placed directly on the ice, where it is secured using the three anchor pins. The rescue aid device 100 can be used on snow, although the rescue aid device 100 may be less secure than on ice. With the rescue aid device 100 so positioned, the loaded line (rope) is typically directed around three to eight degrees below the horizontal. This downward pull on the front of the base 110 tends to pull the base 110 against the surface and force the anchor pins 140 into the ice or snow, further securing the base 110 to the surface.

Once the rescue aid device 100 is secured to the surface, the rope or other object can be extended to the victim. The rescue aid device 100 can then be used in any of a variety of ways to pull the victim to safety.

Use of the winch to pull the victim to safety generally require s that certain precautions be taken. This is because the w inch can bind or lock if not used correctly.

Therefore, in order to pull the victim to safety using the winch, the potential rescuer typically removes any slack in the rope by hand. Once a load is felt, the potential rescue r typically wraps the rope three to four times around the winch drum (clockwise w hen viewed from above). It is important that the rope be wrapped neatly around the drum without overlapping the wraps.

With the rope so attached to the winch drum, the rescue aid device 100 effectively secures the rope. Th e rope may then be pulled i n by hand or using the winch 120.

When pulling in the rope by hand, the winch 120 acts as a brake, but does not provide an y mechanical advantage. The winch 120 will hold the load as long as tension (i.e., a "tailing" force) is maintained on the rope. For convenience, the person providing the "tailing" force is referred to hereinafter as the "tailer." Slack can be obtained by releasing the "tailing" force and allowing the rope to feed out.

If the potential rescuer desires a mechanical advantage to help pull the victim to safety, the potential rescuer installs the provided winch handle and uses the winch handle to operate the winch 120. The winch 120 provides an 8.3:1 mechanical advantage to the potential rescuer so long as a "tailing" force is maintained on the rope, which can be done by the person operating the winch 120 or by another person. The winch 120 has a ratcheting action, so full rotations of the winch handle are not required to reel in the rope. Slack can be obtained by releasing the "tailing" force. Thus, the "tailer" can control the pulling force of the winch by adjusting the "tailing" force. If the "tailer" removes all "tailing" force, then the winch 120 will simply "freewheel" and will not pull in the rope. Therefore, when using the winch 120 to pull the victim to safety, nobody should attempt to "help" the winch 120 by pulling up on the rope ahead of the winch, since this could effectively remove the "tailing" force, thereby rendering the winch 120 ineffective and possibly causing the winch 120 to bind or lock. Wraps can be removed from the winch drum if less friction is desired.

In certain situations, a single rescue aid device may be insufficient to effectuate a rescue. For example, a single rescue aid device may be insufficient to effectuate a rescue if the rescue aid device cannot be affixed securely to the surface or the weight of the victim (or other load being pulled to safety) is too great. Therefore, it may be necessary or desirable to use multiple rescue aid devices to effectuate a rescue.

Once the rescue is complete, the rescue aid device 100 can be removed simply by pulling upward on the back of the base 110. The base 110 and anchor pins 140 detach together. All hardware (especially the hammer, which is typically not stainless steel) should be dried and then stored.

In the described embodiment, three anchor pins driven into the ice or snow at an approximate angle of twenty degrees from vertical are used to affix the base 110 to the surface. However, the present invention is not limited to any particular type or number of mechanical fasteners or to the angle at which the mechanical fasteners are driven into the ice or snow (although some angles will generally be more effective than others).

Although it is preferable for the victim to be at or below the level of the rescue aid device 100, it is possible for the rescue aid device 100 to be used when the victim is above the level of the rescue aid device 100, although the rescue aid device 100 may be less effective, and additional precautions are recommended. With the victim above the level of the rescue aid device 100, the resultant upward force on the base 110 tends to lift the base 110 off of the surface. Therefore, it is recommended that the potential rescuer add additional weight to the top of the base 110, for example, by standing or kneeling on the base 110. Also, with the rope entering the winch 120 from an angle above the winch 120, the winch 120 is more likely to bind or lock. This can be alleviated by passing the rope through a guide that directs the rope into the winch at an appropriate angle.

In the exemplary embodiment described above, a manual, non-self-tailing winch is used to provide a mechanical advantage for pulling the victim to safety. However, the present invention is in no way limited to this type of winch. Other types of winches, including those that do not require a "tailing" force, may be used. The winch may be powered manually or by other means, such as electrically.

When used correctly, the rescue aid device 100 can be a useful tool to help pull a victim to safety. When used incorrectly, however, the rescue aid device 100 can be ineffective and even harmful. Therefore, it is recommended that the rescue aid device 100 be used by professional rescue personnel who are trained in all aspects of ice and water rescue, including operation of the rescue aid device 100. Failure to properly secure the base 110 to the surface at the proper orientation to the victim (i.e., substantially horizontal and slightly above the victim with the front facing directly toward the victim) may reduce the effectiveness of the rescue aid device 100, thereby endangering both the victim and the potential rescuer. Also, improper handling of the winch 120 (e.g., by failing to maintain proper "tailing" force on the rope) may reduce the effectiveness of the winch 120. Particularly with the non-self-tailing winch, it is desirable for two people to operate the rescue aid device 100, one to operate the winch and the other to act as the "tailer" for controlling the "tailing" force on the rope. The winch operator should exercise caution when operating the winch 120, since the mechanical advantage provided by the winch 120 can produce sufficient force to injure the victim.

Figure 2:
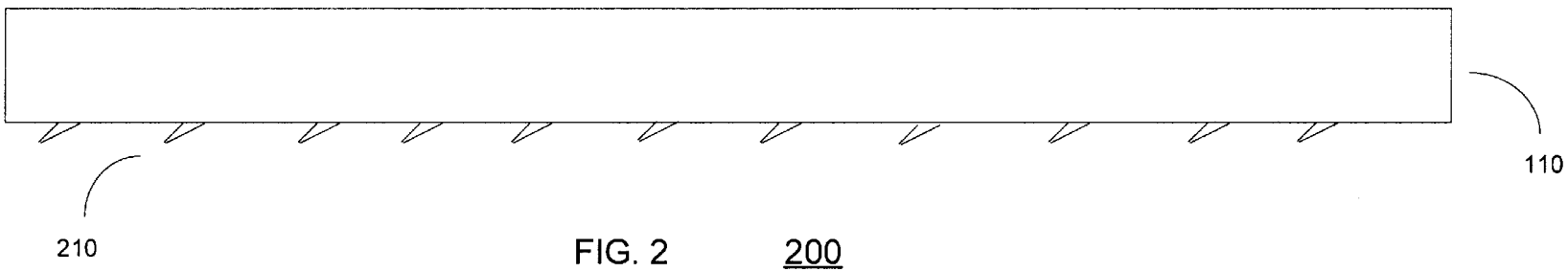
FIG. 2 is a schematic diagram showing an exemplary rescue aid device having a texture on or integral to the bottom of the base in accordance with an embodiment of the present invention.

FIG. 2 shows an exemplary rescue aid device 200 having a texture 210 on or integral to the bottom of the base 110 for affixing the base 110 to the ice or snow. The texture 210 may include spikes or ridges angled forward that can be depressed into the ice or snow. The spikes or ridges help to stop the base 110 from slipping forward. It should be noted that the texture 210 is not limited to any particular texture, pattern, material, position on the base 110, or method of affixing to the base 110.

Figure 3:
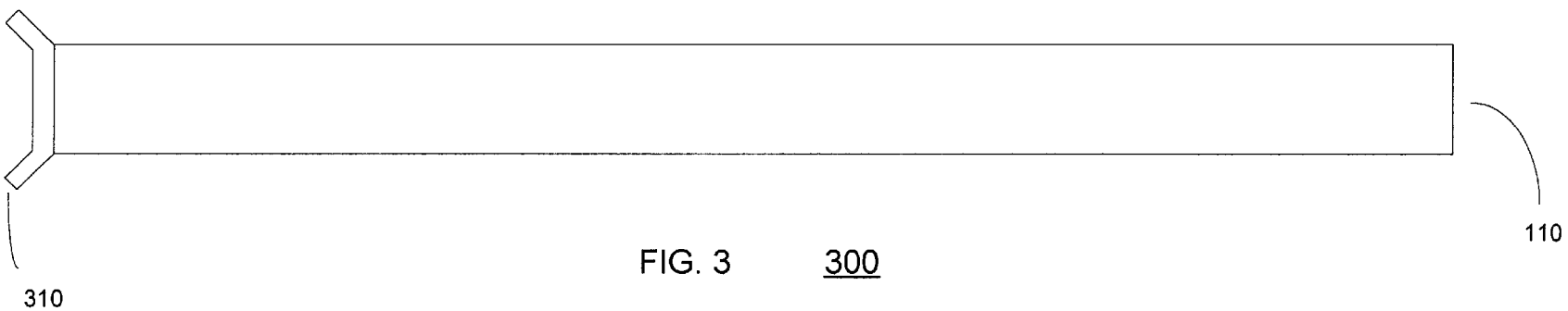
FIG. 3 is a schematic diagram showing an exemplary rescue aid device having an apparatus for providing resistance in accordance with an embodiment of the present invention.

FIG. 3 shows an exemplary rescue aid device 300 including or fitted with an apparatus 310 for providing additional resistance to help stop the base 110 from slipping forward. The apparatus 310 acts as a snow plow or brake to provide resistance to help stop the base 110 from slipping forward. It should be noted that the apparatus 310 is not limited to any particular shape, position on the base 110, or method of affixing to the base 110.

The present invention may be embodied in other specific forms without departing from the true scope of the invention. The described embodiments are to be considered in all respects only as illustrative and not restrictive.

What is claimed is:

1. A rescue aid device comprising:

a base for supporting a rescue, the base comprising at least one guide hole through which at least one mechanical fastener is driven into the ice or snow; and means for affixing the base to ice or snow comprising at least one mechanical fastener that is driven thorough the at least one guide hole into the ice or snow.

2. The rescue aid device of claim 1, wherein said affixing means further comprising a texture on or integral to a bottom of the base.

3. The rescue aid device of claim 1, wherein the at least one mechanical fastener comprising a nail/pin.

4. The rescue aid device of claim 1, wherein the at least one mechanical fastener comprises a screw.

5. The rescue aid device of claim 1, wherein the at least one guide hole is angled forward at a predetermined angle.

6. The rescue aid device of claim 5, wherein the predetermined angle is approximately twenty degrees from vertical.

7. The rescue aid device of claim 1, wherein the at least one guide hole is located toward a back of the base.

8. The rescue aid device of claim 1, further comprising a winch attached to a top of the base.

9. The rescue aid device of claim 8, wherein the winch is attached to the top of the base toward a front of the base.

10. The rescue aid device of claim 1, further comprising a handle integral to the base.

11. A method for effectuating a rescue in ice or snow using a rescue aid device, the rescue aid device comprising a base and a winch attached to a top of the base, the method comprising:

affixing the rescue aid device to the ice or snow; and using the affixed rescue aid device as a secure platform from which to effectuate the rescue by attaching a rope to the winch;

extending the rope to a victim or other load; and using the winch to pull the victim or other load to safety.

12. The method of claim 11, wherein affixing the rescue aid device to the ice or snow comprises depressing a bottom of the base into the ice or snow.

13. The method of claim 11, wherein affixing the rescue aid device to the ice or snow comprises affixing the rescue aid device to the ice or snow using at least one mechanical fastener.

* * * * *

UNITED STATES PATENT AND TRADEMARK OFFICE

CERTIFICATE OF CORRECTION

PATENT NO. : 6,520,817 B1 
DATED : February 18, 2003
INVENTOR(S) : Allan J. Salzman It is certified that error appears in the above-identified patent and that said Letters Patent is hereby corrected as shown below:

Column 6,
Lines 25 and 28, replace “comprising” with -- comprises --.

Signed and Sealed this

Fifteenth Day of April, 2003

JAMES E. ROGAN
*Director of the United States Patent and Trademark Office*